US007086903B2

(12) United States Patent
Takada

(10) Patent No.: US 7,086,903 B2
(45) Date of Patent: Aug. 8, 2006

(54) ELECTRICAL CONNECTOR

(75) Inventor: Toshiyuki Takada, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/024,477

(22) Filed: Dec. 30, 2004

(65) Prior Publication Data

US 2005/0170697 A1 Aug. 4, 2005

(30) Foreign Application Priority Data

Jan. 30, 2004 (JP) ..... 2004-022564

(51) Int. Cl.
*H01R 31/06* (2006.01)

(52) U.S. Cl. ..... 439/628

(58) Field of Classification Search ..... 439/628, 439/108, 83, 326, 74, 101, 79, 65, 631, 638, 439/636, 59, 62, 60, 637
See application file for complete search history.

(56) References Cited

U.S. PATENT DOCUMENTS

| | | | | |
|---|---|---|---|---|
| 5,026,292 | A * | 6/1991 | Pickles et al. | 439/108 |
| 5,496,180 | A * | 3/1996 | Fabian et al. | 439/60 |
| 6,019,639 | A * | 2/2000 | Brunker et al. | 439/637 |
| 6,341,966 | B1 * | 1/2002 | Takada et al. | 439/108 |
| 6,695,622 | B1 * | 2/2004 | Korsunsky et al. | 439/65 |

FOREIGN PATENT DOCUMENTS

US 2001-143786 5/2001

* cited by examiner

*Primary Examiner*—Truc T. Nguyen
*Assistant Examiner*—Edwin A. Leon
(74) *Attorney, Agent, or Firm*—Takeuchi & Kubotera, LLP

(57) ABSTRACT

An electrical connector includes an insulative housing (2) attachable to a first board and having a receiving recess (8) for receiving a second board in a first direction; and a plurality of terminals (3) arranged in the receiving recess in a second direction perpendicular to the first direction. Each terminal (3) has a pair of contact sections (14, 15) to be brought into spring contact with a pair of connection lands (5) provided on front and back edge sections (20) on front and back surfaces of a second board. The pair of connection lands (5) on the front and back edge sections are short-circuited and offset in the second direction. The pair of contact sections are offset in the second direction.

6 Claims, 7 Drawing Sheets

ELECTRICAL CONNECTOR

BACKGROUND OF THE INVENTION

1. Field of the Invention

The present invention relates to an electrical connector having terminals with contact sections in spring contact with the connection sections provided on front and back sides of a board and such a board.

2. Description of the Related Art

JP 2001-143786 discloses two connectors connected by an interconnection board. The interconnection board has a plurality of connection lands arranged on opposite edges of front and back sides thereof. The connection lands in corresponding pairs on the front and back sides are short-circuited with conductive through-holes.

The connector has a plurality of terminals each with a pair of contact sections to be brought into spring contact with the connection lands provided on the front and back sides of the interconnection board.

However, the capacitance of the connection sections is so large as to cause impedance mismatch in high-speed signal transmissions. The area of the connection land is made large to assure stable contact with the contact section of the terminal. The connection lands are disposed on the front and back sides of the interconnection board to make perfect pairs across the interconnection board to form large capacitance.

SUMMARY OF THE INVENTION

Accordingly, it is an object of the invention to provide an electrical connector and a circuit board capable of minimizing the capacitance produced between the corresponding connection lands of the circuit board.

According to the invention there is provided an electrical connector which includes an insulative housing attachable to a first board and having a receiving recess for receiving a second board in a first direction; and a plurality of terminals arranged in the receiving recess in a second direction perpendicular to the first direction. Each terminal has a pair of contact sections to be brought into spring contact with a pair of connection lands provided on front and back edge areas on front and back surfaces of a second board. The pair of connection lands on the front and back edge areas are short-circuited and offset in the second direction. The pair of contact sections are offset in the second direction.

Since the corresponding connection lands are offset in the second direction, the overlap area of the corresponding connection lands is reduced, thereby minimizing the capacitance produced between the corresponding connection lands.

The contact sections of the terminal may be offset in the first direction so that the second board is plugged at two stages, resulting in the reduced plugging force. It is preferred that the contact sections of terminals are staggered in the first direction, thereby preventing the second board from tilting in the third direction. The second board may be an arranging board of a second connector or an interconnection board having connection lands on another edge area to be connected to a second connector.

The terminal is made by processing a sheet of metal in a third direction perpendicular to the first and second direction and having a connection section projecting from the housing and a retention section held by the housing except that a portion thereof may be spaced from the housing to prevent a molten flux from moving upward by capillary action to the contact section.

According to the invention there is also provided a circuit board having a plurality of connection lands on the edge area on either side of the circuit board, with the corresponding connection lands on both the sides being short-circuited and offset in the second direction. It may work as an interconnection board having a plurality of connection lands on each of a plurality of edge areas, with the corresponding connection lands on both the sides being short-circuited, to which a connector is connected. The connection lands include signal connection lands and ground connection lands, with both contact sections are staggered, and the ground connection lands on at least one side communicate with each other to form a ground layer.

As has been described above, according to the invention, the connection lands provided on both sides of a second board and short circuited in corresponding pairs are offset in the second direction so that the capacitance between the pairs of connection lands is minimized, making a good high-speed signal transmission path between the terminal and the connection lands.

DESCRIPTION OF THE PREFERRED EMBODIMENTS

An embodiment of the invention will now be described with reference to FIGS. 1–6.

Figure 1:
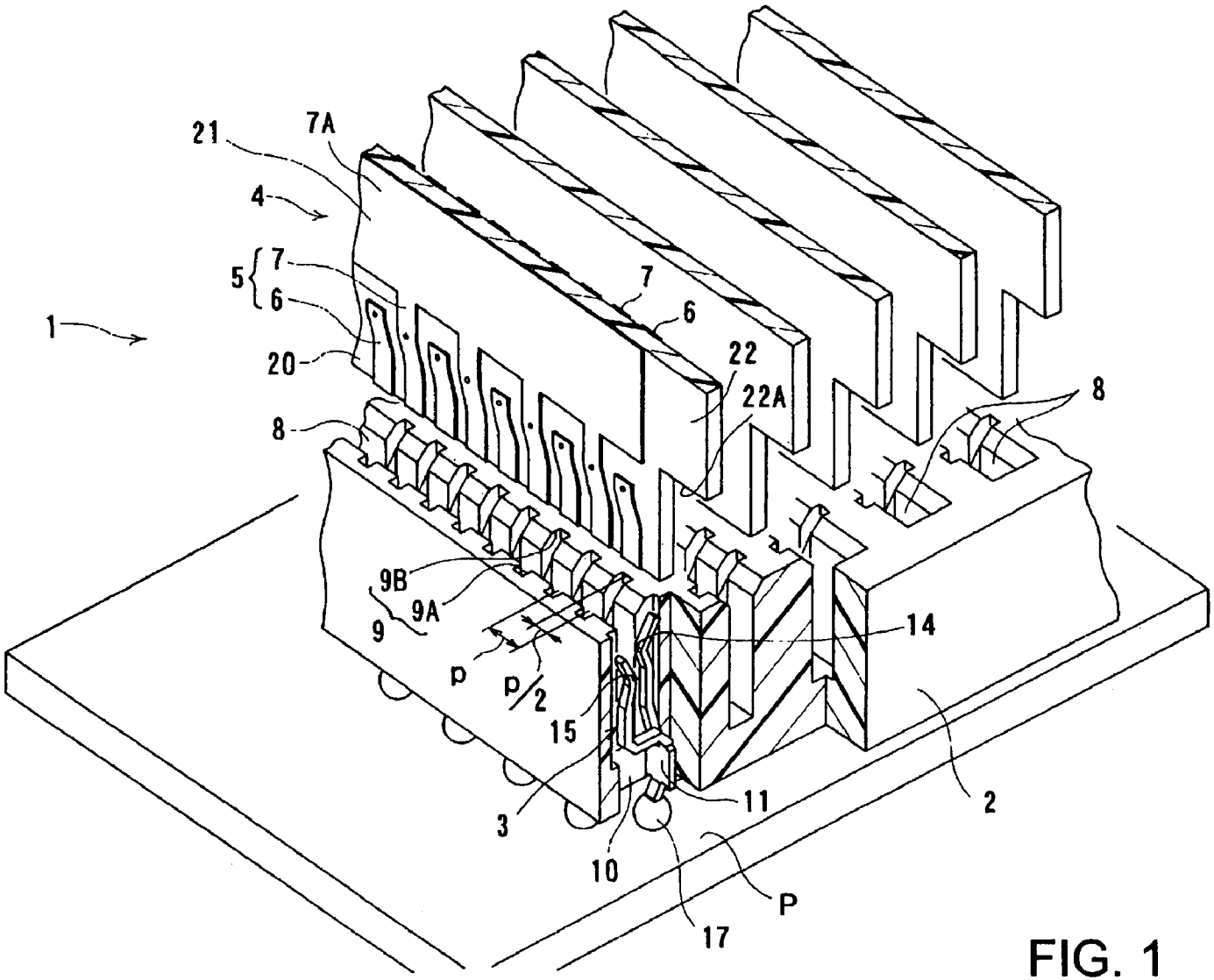
FIG. 1 is a perspective view of an electrical connector according to an embodiment of the invention.

In FIG. 1, a connector 1 is attached to a printed circuit (PC) board P for example. The circuit section to which a terminal of the connector 1 is to be connected is omitted from the drawing. The connector 1 includes a housing 2 made of an insulative material and a plurality of terminals 3 that are made by stamping and bending a sheet of metal and arranged in the housing 2.

The housing 2 has a rectangular shape and a plurality of rows of receiving recesses 8 extending downward from the top face for receiving in the plugging direction a connection section 5 including signal connection lands 6 and ground connection lands 7 of a daughter board 4. A pair of terminal grooves 9 (9A, 9B) for receiving a pair of opposed contact sections of each terminal 3 are provided in opposed walls of the receiving recess 8. The opposed terminal grooves 9A and 9B are offset by p/2 in the terminal arranging direction wherein p is the terminal arranging pitch. The terminal grooves 9A and 9B extend to the bottom of the receiving recess 8. A plurality of apertures 10 are provided in the housing 2 such that the lower connection section of the terminal 3 fitted in the terminal grooves 9A and 9B projects from the housing 2.

Figure 2:
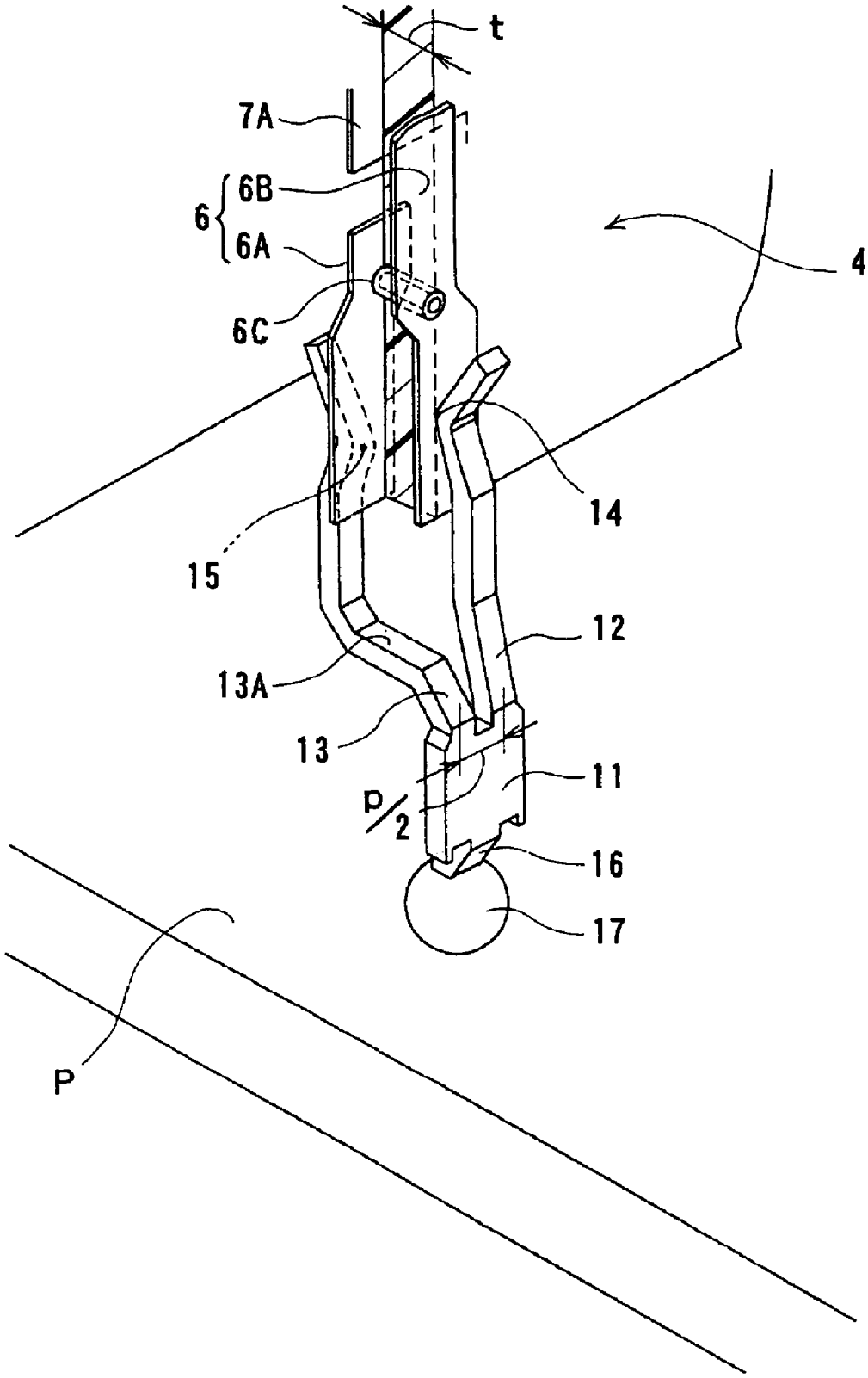
FIG. 2 is a perspective of a terminal for the electrical connector.

In FIG. 2, the terminal 3 is made by stamping and bending a sheet of metal so as to have a retention section 11 to be held by the housing 3 and a pair of branches 12 and 13 extending upward from the retention section 11 such that their center lines are spaced by p/2 in the terminal arranging direction as described above. The branch 12 extends upward substantially along a plane of the retention section 11 and has a V-shaped upper end forming a contact section 14. The other branch 13 has a substantially right-angle section 13A near the retention section 11 and a V-shaped contact section 15 opposed to the contact section 14.

Figure 3:
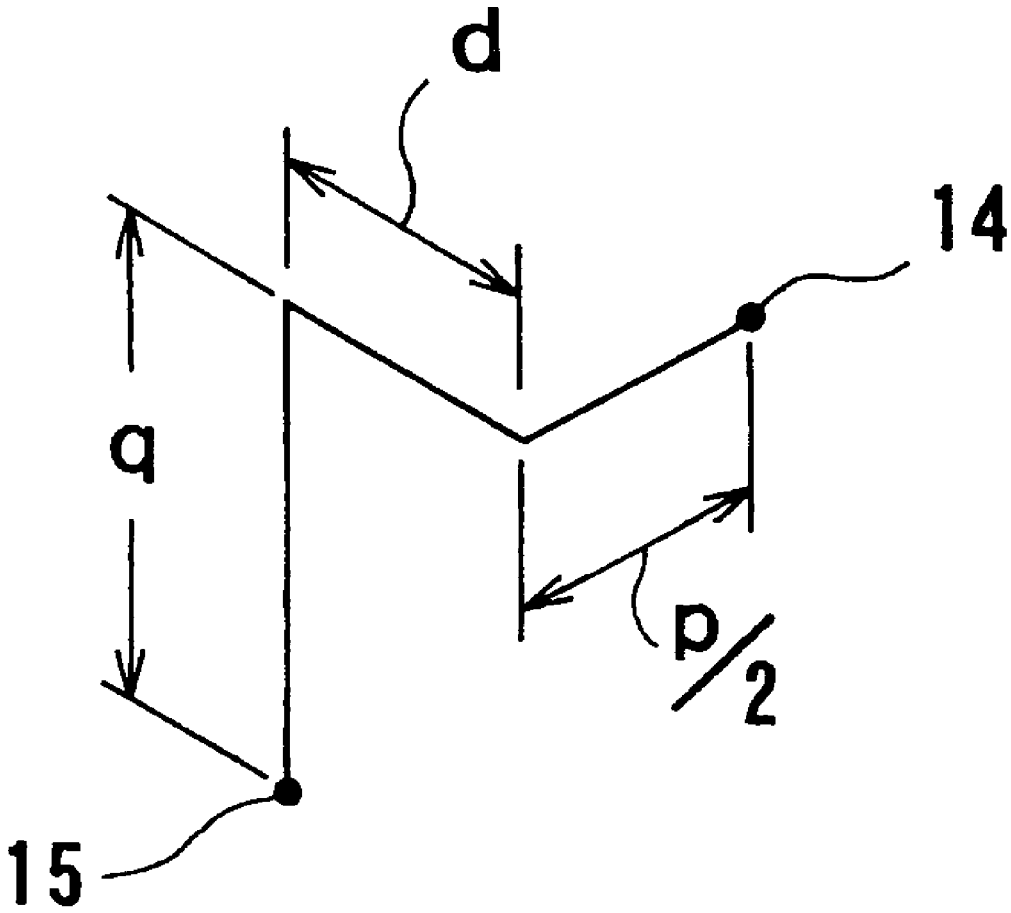
FIG. 3 is a schematic diagram of contact sections of the terminal.

In FIG. 3, the contact section 15 is disposed at a position lower than that of the contact section 14 by the quantity of q. The distance d between the contact sections 14 and 15 in the direction of the sheet thickness is made a little less than the thickness of the daughter board 4 so that the contact sections 14 and 15 of the branches 12 and 13 are brought into spring contact with the connection lands 6B and 6A of the daughter board 4. The terminal 3 has a connection section 16 extending downward from the retention section 11 and having a solder ball 17 thereon.

Figure 4:
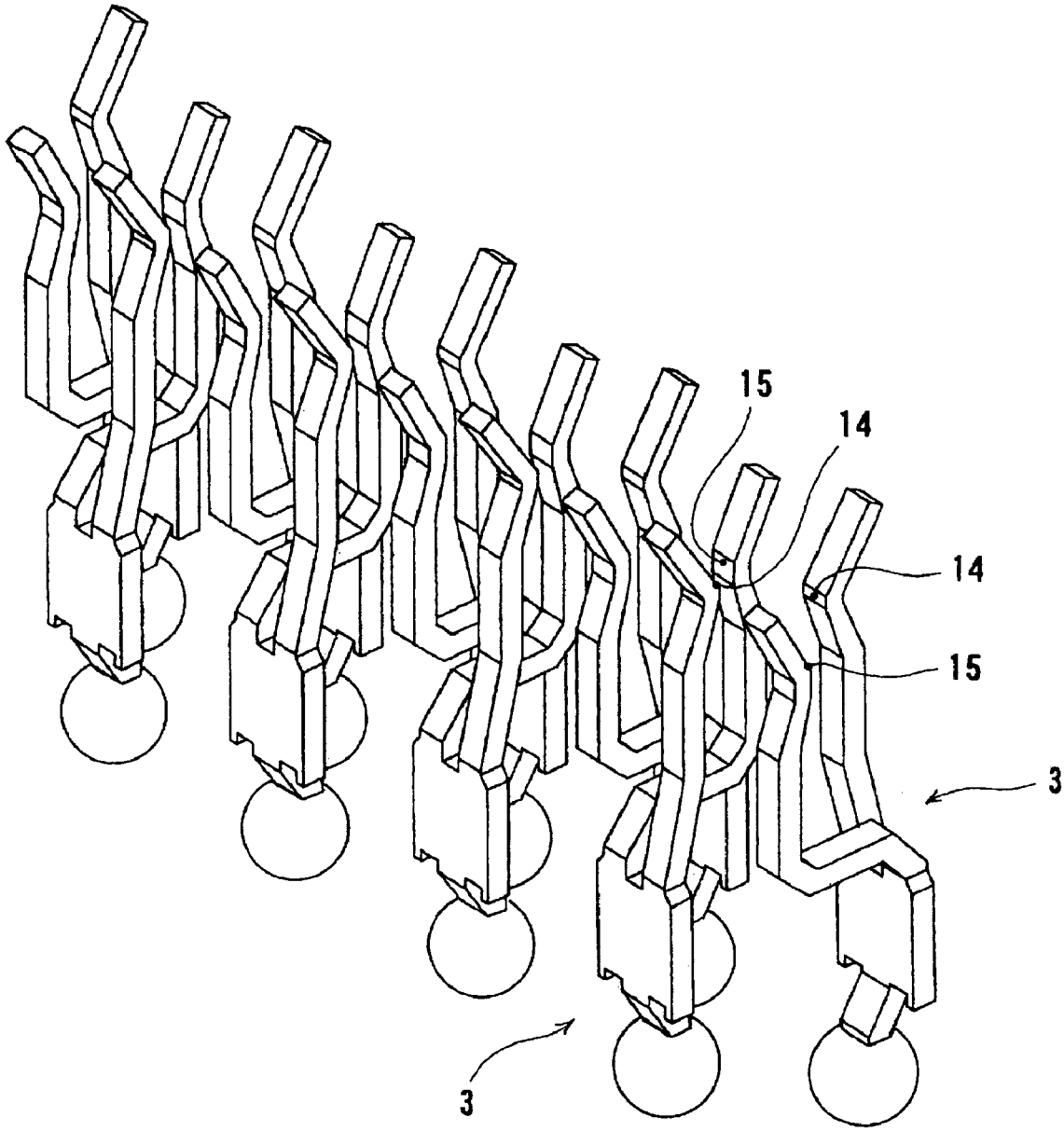
FIG. 4 is a perspective view of an arrangement of the terminals.
Figure 5A:
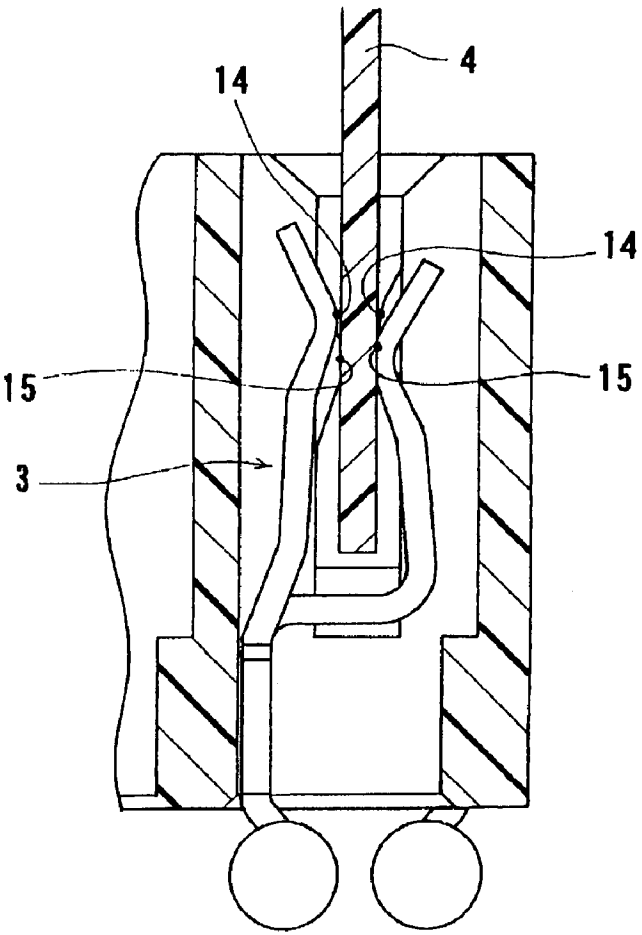
FIGS. 5(A) and (B) are sectional views taken along a plane perpendicular to the direction in which the terminals are arranged.
Figure 5B:
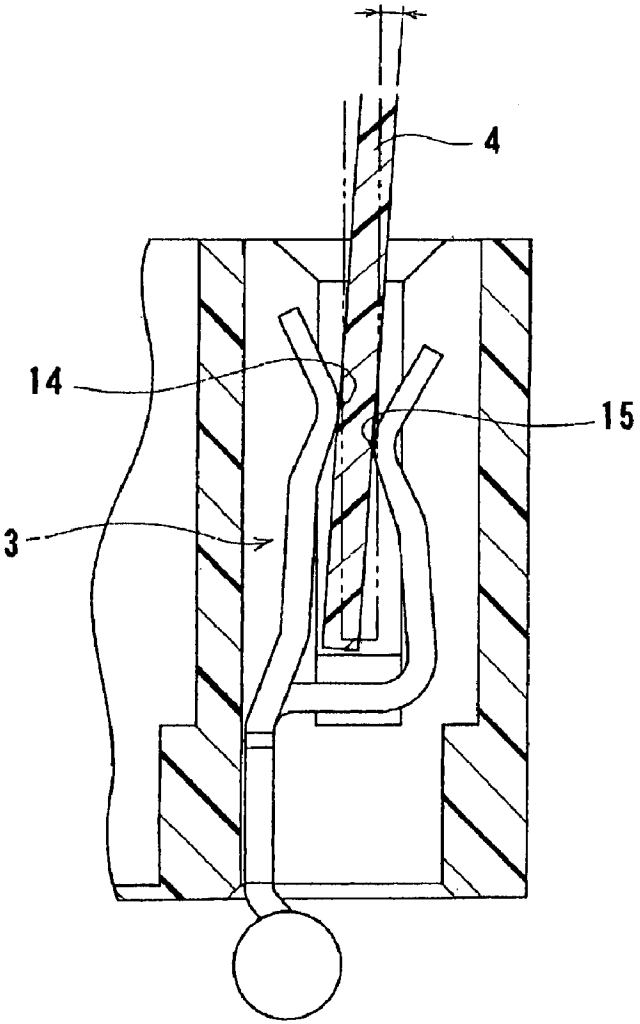

In FIG. 4, the terminals 3 are alternately arranged such that the contact sections 14 and 15 are staggered. Consequently, the daughter board 4 is brought into contact with the contact sections 14 and 15 that are offset alternately in height as shown in FIG. 5(A). Alternatively, the terminals 3 are arranged in the same row as shown in FIG. 5(B) so that the daughter board 4 tends to tilt to the right in the figure.

Figure 6:
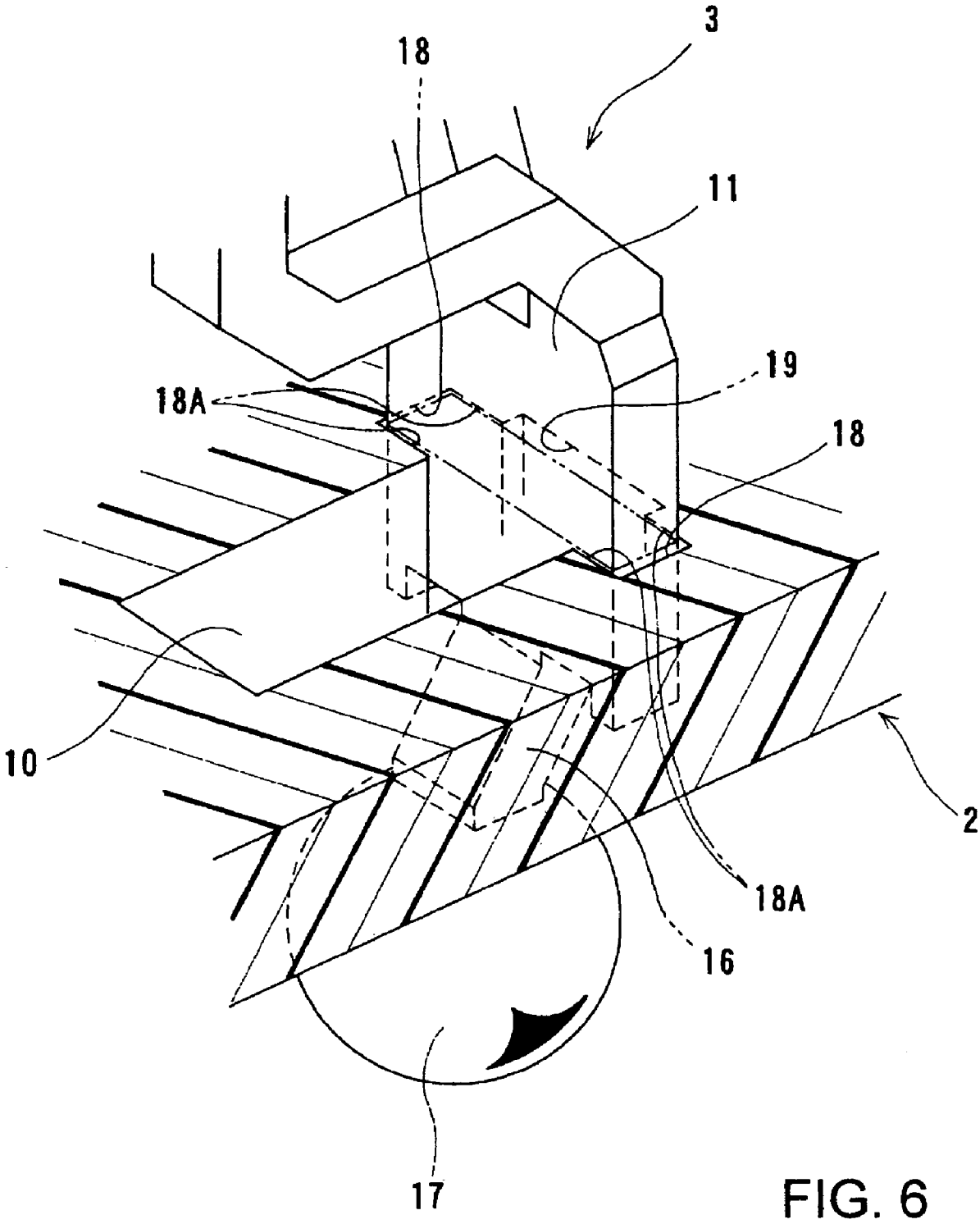
FIG. 6 is a perspective view of a retention section of the terminal.

In FIG. 6, the terminal 3 is inserted into the terminal grooves 9A and 9B in the opposed walls of the receiving recess 8 and held at the bottom of the housing 2. A retention groove 18 is provided in the bottom of the housing 2 so as to have a width a little smaller than the thickness of the retention section 11 so that the opposed retention walls 18A holds the press-fitted retention section 11 of the terminal 3. An indented section 19 is provided between the retention walls 18A so that the retention section 11 is spaced from the retention walls 18A. The depth of the indented section 19 is sufficiently large that the molten flux for soldering does not come up by capillary action. The aperture 10 on the other side of the retention section 11 allows the contact section 15 of the terminal 3 to project downward. This aperture 10 also form an indented section from the retention walls 18A. Alternatively, the terminal may be made by stamping and twisting with respect to the plane of the receiving recess 8.

The daughter board 4 has a lower edge or arranging section 20 on which a plurality of connection lands are arranged and inserted into the receiving recess 8 of the housing 8. The lower edge section 20 has a size suitable for insertion into the receiving recess 8. A circuit section 21 above the lower edge section 20 has an extended portion 22 projecting laterally from the lower edge section 20 and having a lower edge or stopper 22A. When the lower edge section 20 of the daughter board 4 is inserted into the receiving recess 8, the stopper 22A abuts against the top surface of the housing 2 to stop the insertion at a predetermined position.

The connection lands 5 include signal connection lands 6 and ground connection lands 7 arranged alternately on the lower edge section 20. The signal connection lands 6 on a side of the daughter board 4 (FIG. 1) are provided within the lower edge section 20 while the ground connection lands 7 extend to the circuit section 21 and join with a single ground layer 7A. On the other side of the daughter board 4 (FIG. 2), the signal and ground connection lands 6 and 7 extend upward for connection with the corresponding circuit trances. The surface of the ground layer may be treated with resist.

Similarly to the contact sections 14 and 15, the portion of a signal connection land 6A below the through-hole 6C is offset by p/2 from the signal connection land 6B. This holds for the ground connection land 7, too. Consequently, the overlapping area of the opposed connection lands 5 on the opposite sides of the daughter board 4 is minimized to reduce the capacitance between them, thereby allowing high-speed signal transmission.

Since the contact sections 14 and 15 are offset in the plugging direction, when the daughter board 4 is inserted into the receiving recess 8 such that the connection section 5 is inserted between the contact sections 14 and 15, the insertion force works at two stages and can be minimized. As shown in FIG. 4, the contact sections 14 and 15 are staggered, the daughter board 4 is held at positions distributed uniformly in both the terminal arranging direction and the plugging direction so that it does not tilt in the terminal thickness direction. If this tilt is tolerated or corrected by other means, such terminal arrangement as shown in FIG. 5(B) can be employed.

When the terminal 3 is soldered to the PC board P with the solder ball 17, the indented section 19 prevents the upward movement by capillary action of the molten flux along a gap between the terminal and the housing. The overlap area of opposed connection sections can be set by changing the offsetting in the terminal arranging direction. The maximum offset is defined by the fact that there is no overlap between them. The through-hole may be replaced with a conductor running around the lower edge of the daughter board.

Figure 7A:
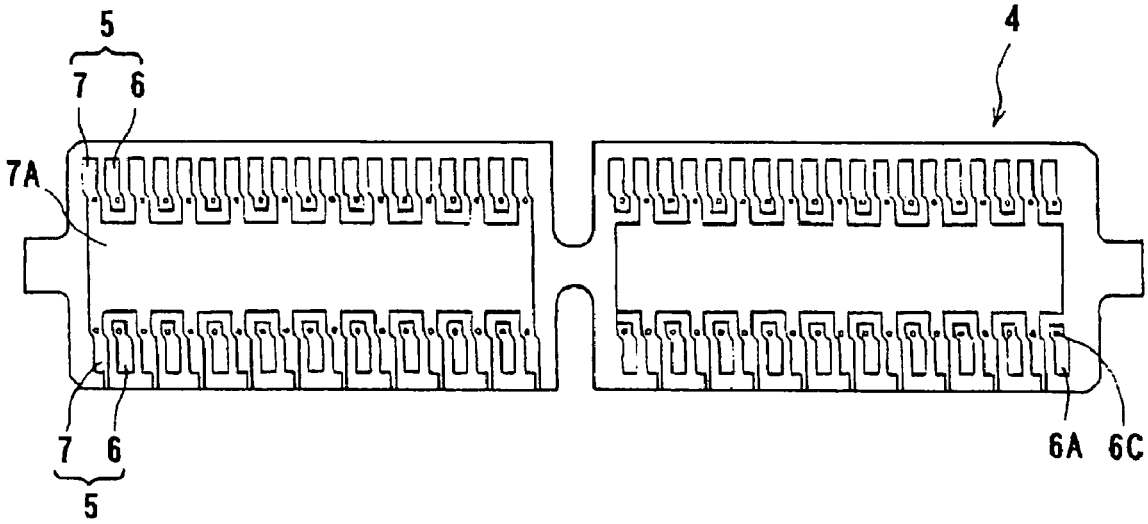
FIGS. 7(A) and (B) are plan views of front and back sides of a substrate.
Figure 7B:
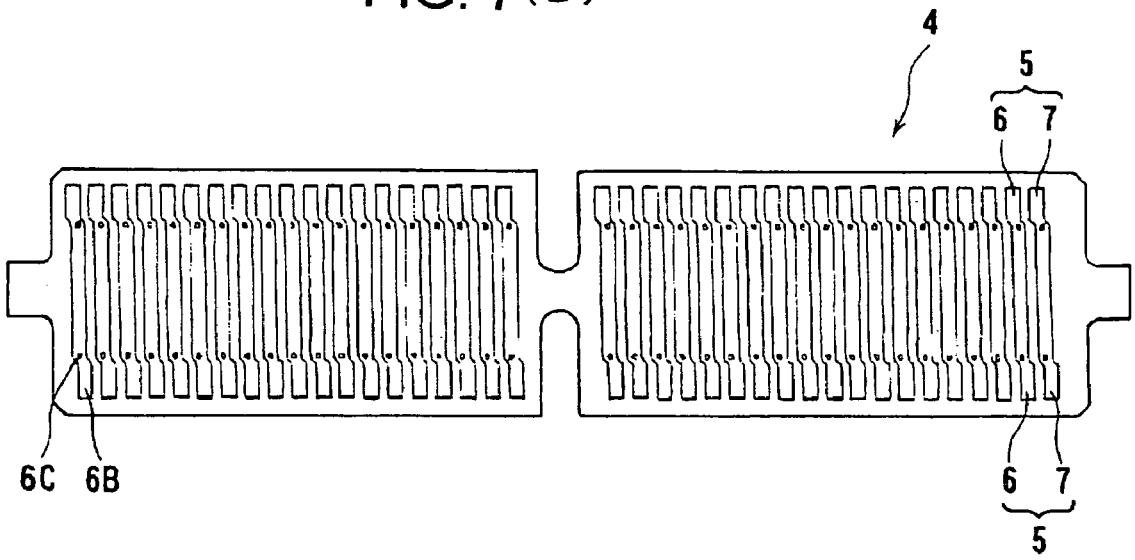

In FIGS. 7(A) and (B), another connection section is provided in an area other than the lower edge section, and the corresponding lands are connected with a circuit of the circuit section. Another connector is connected to the other connection section so that the daughter board can be used as an interconnection board. The daughter board may be a terminal arranging plate of another connector or a flexible board. The indented section for preventing the upward movement of the molten flux may be distributed to a plurality of locations.

The invention claimed is:

1. An electrical connector comprising:

an insulative housing attachable to a first board and having at least one receiving recess for receiving a second board in a first direction; and a plurality of terminals arranged in said receiving recess in a second direction perpendicular to said first direction, each terminal having a pair of contact sections to be brought into spring contact with a pair of connection lands provided on edge sections on opposite surfaces of said second board, said pair of connection lands on said opposite surfaces being offset in said second direction so as to be away from each other and extend toward inside sections of said second board forming conductor portions;

said pair of contact sections being offset in said second direction so that said contact sections may be brought into contact with said connection lands offset in said second direction;

said pair of conductor portions on said opposite surfaces of said second board being offset in said second direction toward each other so that said pair of offset conductor portions may be short-circuited at the same position in said second direction.

2. The electrical connector according to claim 1, wherein said pair of contact sections are offset in said first and second directions.

3. The electrical connector according to claim 2, wherein said terminals are arranged such that said contact sections are staggered in said first direction.

4. The electrical connector according to claim 1, wherein said second board is a board of a second connector.

5. The electrical connector according to claim 1, wherein said second board is an interconnection board with second edge sections having at least one pair of connection lands to be connected to a second connector.

6. The electrical connector according to claim 1, wherein said terminals each are made by processing a sheet of metal to form said contact sections offset in said first and second directions, and having a connection section projecting from said insulative housing and a retention section to be held by said insulative housing except for a portion thereof being spaced from said insulative housing.

* * * * *